US006432589B1

(12) United States Patent
Uchinokura et al.

(10) Patent No.: US 6,432,589 B1
(45) Date of Patent: Aug. 13, 2002

(54) IMAGE FORMATION METHOD, ELECTROPHOTOGRAPHIC TONERS, AND PRINTED MATTER

(75) Inventors: Osamu Uchinokura; Hachiroh Tosaka; Hiroshi Yamashita; Shinichi Kuramoto, all of Shizuoka; Masae Nakamura; Takashi Yamamoto, both of Kanagawa; Masakazu Kinoshita, Hyogo; Yoshimi Mizoguchi; Yoshimichi Katagiri, both of Kanagawa, all of (JP)

(73) Assignees: Ricoh Company, Ltd., Tokyo; Fujitsu Limited, Kawasaki, both of (JP)

( * ) Notice: Subject to any disclaimer, the term of this patent is extended or adjusted under 35 U.S.C. 154(b) by 0 days.

(21) Appl. No.: 09/636,507

(22) Filed: Aug. 10, 2000

(30) Foreign Application Priority Data

Aug. 10, 1999 (JP) ..... 11-226323

(51) Int. Cl.[7] ..... G03L 3/00

(52) U.S. Cl. ..... 430/18; 430/42; 430/45; 430/107.1

(58) Field of Search ..... 430/18, 42, 45, 430/107.1

(56) References Cited

U.S. PATENT DOCUMENTS 6,274,282 B1 * 8/2001 Sugimoto et al. ..... 430/18

* cited by examiner

*Primary Examiner*—Mark Chapman
(74) *Attorney, Agent, or Firm*—Oblon, Spivak, McClelland, Maier & Neustadt, P.C.

(57) ABSTRACT

An image formation method for forming an image is proposed, which uses an image formation apparatus capable of performing (1) multi-color image formation and printing by superimposing toner images with different colors by use of a plurality of color toners with different colors, including at least a black toner, and (2) monochrome image formation and printing, using only a black toner, with a maximum transferable amount of each color toner onto the image being in a range of $4\times10^{-3}$ kg/m$^2$ to $8\times10^{-3}$ kg/m$^2$, wherein an image glossiness (GKC) obtained by the black toner in the maximum transferable amount thereof at the multi-color image printing, an image glossiness (GCC) obtained by each of the color toners other than the black toner in the maximum transferable amount thereof at the multi-color image printing, and an image glossiness (GKM) obtained by the black toner in the maximum transferable amount thereof at the monochrome image printing satisfy a particular relationship as described in the specification. In addition, the above toners and a printed matter prepared by this image formation method are proposed.

10 Claims, 1 Drawing Sheet

FIGURE
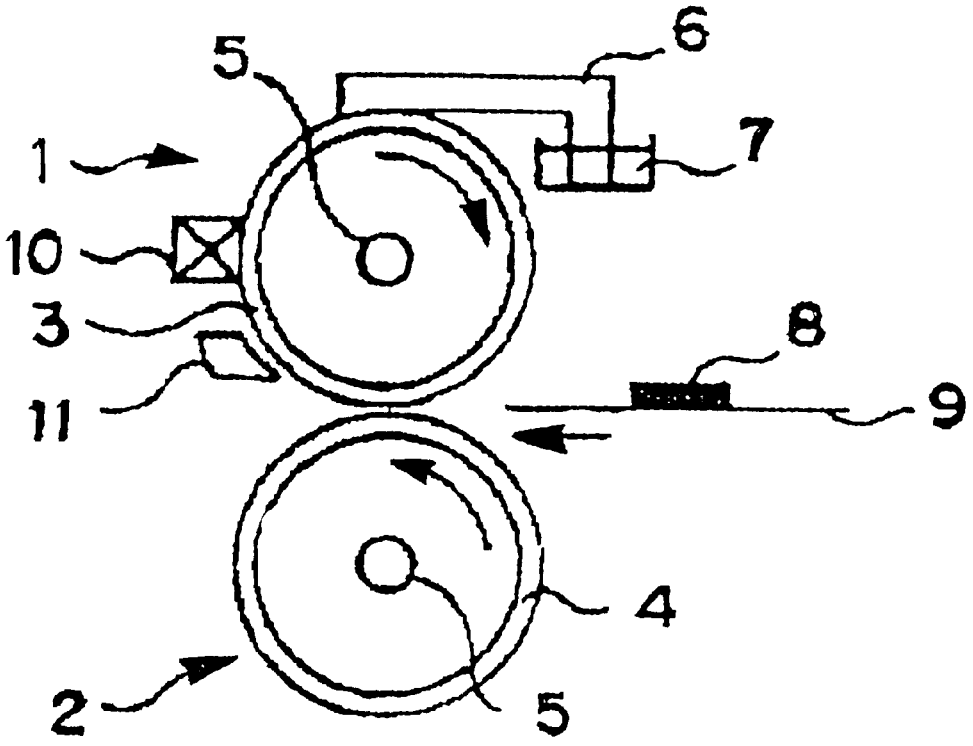

IMAGE FORMATION METHOD, ELECTROPHOTOGRAPHIC TONERS, AND PRINTED MATTER

BACKGROUND OF THE INVENTION

1. Field of the Invention

The present invention relates to an image formation method, electrophotographic toners for use in the image formation method, and a printed matter produced by the image formation method.

2. Discussion of Background

Conventionally, there are known a method and apparatus for full-color electrophotography for the formation of multi-color images, which can be attained by repeating an image formation process comprising the steps of forming latent electrostatic images on a latent electrostatic image bearing material such as an electrophotographic photoconductor, based on a color image information, developing the latent electrostatic images with toners with colors corresponding to the latent electrostatic images to form toner images, transferring the toner images to an image receiving material, and fixing the toner images to the image receiving material with the application of heat thereto, thereby obtaining multi-color images.

It is required such multi-color images have an appropriate glossiness, for instance, in the case of reproduction of multi-color images from photographs. It is also required that the toner layers of the obtained images be made flat. In order to obtain such flat toners layer, binder resins with a low melting point are generally used in the color toners.

In recent years, electrophotographic color copying machines and color printers are widely used. The reproduction of full-color images by such a color copying machine or a color printer is relatively good in quality. However, monochrome images are not reproduced often by the color copying machine or the color printer. This is because the speed of the reproduction of monochrome image by the color copying machine or the color printer is lower than that by a monochrome copying machine or a monochrome printer, and the monochrome image reproduced by the color copying machine or the color printer and the monochrome image reproduced by the monochrome copying machine or the monochrome printer differ in quality. Therefore, currently, color images are reproduced by the color copying machine or color printer, while monochrome images are exclusively reproduced by the monochrome copying machine or the monochrome printer. In other words, currently the color copying machines and color printers are clearly segregated from the monochrome copying machines and monochrome printers in terms of the application. This makes it difficult to expand the use of the color copying machine or color printer in offices where monochrome images are mainly reproduced.

In particular, with respect to the monochrome image, a mat finish, which is not shiny, is conventionally preferred. In other words, there is a tendency that a monochrome image produced by the color copying machine or the color printer, which is shiny, is not preferred.

With respect to a black toner, there is a method of controlling the glossiness of the image produced by the black toner by containing therein a polymeric resin with a relatively high melting point. The polymeric resin is the same polymeric resin as used in the black toner for use in the monochrome copying machine or the monochrome printer. For example, in Japanese Laid-Open Patent Application 6-148935, it is proposed to control the molecular weight distribution and the fused melting point of a resin component used in a black toner, and to change the quantity of heat applied to the black toner, depending upon the choice of monochrome copy image formation or color copy image formation, thereby controlling the glossiness of the image produced by the black toner. Even if the various properties of the black toner are controlled, it is still possible that in the multi-color reproduction, the glossiness of the color images produced by the color toners other than the black toner markedly differs from the glossiness of the black image produced by the black toner. When this takes place, for instance, in an image of a human face reproduced from a photograph which includes black portions, the reproduced image may look considerably awkward. In particular, when a character portion and a photographic portion are mixed in an image to be reproduced from a full-color photograph, a significant difference in glossiness is caused between a highlight portion in the photographic portion and the character portion when reproduced. This will make both the characters and other images look bad.

Generally, the glossiness of a toner image tends to be proportional to the amount of the toner transferred for the formation of the toner image. Therefore, an image developed with a small amount of a toner tends to have a low glossiness, while an image developed with a large amount of a toner tends to have a high glossiness. These characteristics can be advantageously utilized for controlling the contrast of monochrome toner images to some extent. However, in the reproduction of a full-color image, in particular, from a photograph, a larger amount of a black toner tends to be transferred to a black portion of the image since the black portion has a higher density in comparison with the other portions of the image.

In the case where each of the black toner and the color toners other than the black toner produces an image with the same glossiness when used alone, a full-color image produced from a full-color photograph by use of such color toners and black toner does not look good with an unbalanced glossiness of each color. This is because black portions in the full-color image tend to have an extremely higher glossiness in comparison with the other color portions.

In order to solve the above-mentioned problems, Japanese Laid-Open Patent Application 10-268562 proposes a color copying machine capable of providing a predetermined difference in glossiness between a color portion produced by color toners and a black portion produced by a black toner in a color image to be reproduced. The proposed color copying machine, however, cannot completely control the glossiness of the image reproduced by the black toner to form a mat black image when a monochrome image is reproduced, so that this color copying machine cannot be used as a monochrome copying machine as well.

On the other hand, the adjustment of the glossiness of the image obtained depends not only upon the above discussed conditions for each toner, but also upon the amount of each toner used on the recording material, the structure of an image fixing unit used, and image fixing conditions adopted in the image formation method. For example, in Japanese Laid-Open Patent Application 4-1670, there is proposed an image fixing unit which is capable of selecting image fixing conditions in accordance with the kind of recording material employed. However, the black color in the color image cannot be adjusted only by changing the image fixing conditions described in the reference.

Color toners have problems that the coloring performance and the light transmittance through an OHP sheet are lowered due to imperfect fusing of the color toners. In order to prevent such problems, an oil is applied to the image fixing roller for the color copying machine, thereby carrying out sufficient image fixing and preventing the offset of the toners at image fixing. However, in many cases, the application of such an oil to the image fixing roller will have an adverse effect on the glossiness of the image reproduced.

SUMMARY OF THE INVENTION

It is therefore a first object of the present invention to provide an image formation method capable of controlling the glossiness of a black portion in a multi-color image in multi-color formation, thereby producing a well-balanced, good-looking image, and also capable of producing a mat monochrome image in monochrome image formation, which is preferred by the user.

A second object of the present invention is to provide a set of color toners including a black toner for use in the above-mentioned image formation method.

A third object of the present invention is to provide a printed matter produced by the above-mentioned image formation method.

The first object of the present invention can be achieved by an image formation method capable of forming an image, using an image formation apparatus capable of performing (1) multi-color image formation and printing by superimposing toner images with different colors by use of a plurality of color toners with different colors, including at least a black toner, and (2) monochrome image formation and printing, using only a black toner, with a maximum transferable amount of each color toner being in a range of $4\times10^{-3}$ kg/m$^2$ to $8\times10^{-3}$ kg/m$^2$, wherein an image glossiness (GKC) obtained by the black toner in the maximum transferable amount thereof at the multi-color image printing, an image glossiness (GCC) obtained by each of the color toners other than the black toner in the maximum transferable amount thereof at the multi-color image printing, and an image glossiness (GKM) obtained by the black toner in the maximum transferable amount thereof at the monochrome image printing satisfy the relationship of:

$$4 \leqq GKC \leqq 25(\%),$$

$$5 \leqq GCC \leqq 30(\%),$$

$$1 \leqq GKM \leqq 10(\%),$$

$$0.5 \leqq GKC/GCC \leqq 0.9,$$

$$0.1 \leqq GKM/GKC \leqq 0.7,$$

and $$GKM \leqq GKC \leqq GCC.$$

In the above image formation method, the multi-color image printing and the monochrome image printing respectively comprise multi-color image fixing and monochrome image fixing which are conducted at an identical image fixing temperature and at an identical nip pressure, with the respective image fixing line speeds satisfying the conditions of:

1.2≦(image fixing line speed at monochrome image printing/image fixing line speed at multi-color image printing)≦2.0.

Furthermore, in the above-mentioned image formation method, each of the plurality of the color toners other than the black toner may be an electrophotographic toner comprising a coloring agent, and a resin component with a weight-average molecular weight (Mw) of 10,000 to 25,000, and a number-average molecular weight (Mn) of 2,000 to 7,000, with the ratio of the weight-average molecular weight (Mw) to the number-average molecular weight (Mn), Mw/Mn, being 3 to 10, and the black toner may be an electrophotographic toner comprising a coloring agent, the above-mentioned resin component, and at least one sub-resin component which is non-compatible with the resin component in an amount of 1 to 10 parts by weight to 100 parts by weight of the resin component.

The plurality of the color toners other than the black toner may comprise a yellow color toner, a magenta color toner, and a cyan color toner.

As the resin component, polyester resin can be employed. It is preferable that the sub-resin component have an MI value of 1 to 30. The MI value indicates the value of the melt index of the sub-resin component.

As the sub-resin component, styrene/acrylic resin can be employed.

Furthermore, in the above image formation method, the multi-color image fixing and the monochrome image fixing can be conducted, using an image fixing roller which is coated with a silicone oil component with a viscosity of 1 to 1000 stokes in an amount of $3\times10^{-5}$ kg/m$^2$ to $8\times10^{-5}$ kg/m$^2$.

The second object of the present invention can be achieved by a set of toners, comprising a plurality of color toners including a black toner, wherein each of the color toners other than the black toner is an electro-photographic toner comprising a coloring agent, and a resin component with a weight-average molecular weight (Mw) of 10,000 to 25,000, and a number-average molecular weight (Mn) of 2,000 to 7,000, with the ratio of the weight-average molecular weight (Mw) to the number-average molecular weight (Mn), Mw/Mn, being 3 to 10, and the black toner is an electrophotographic toner comprising a coloring agent, the above-mentioned resin component, and at least one sub-resin component which is non-compatible with the resin component in an amount of 1 to 10 parts by weight to 100 parts by weight of the resin component.

In the above-mentioned set of toners, the plurality of the color toners other than the black toner may comprise a yellow color toner, a magenta color toner, and a cyan color toner.

As the resin component, polyester resin can be employed. It is preferable that the sub-resin component have an MI value of 1 to 30. As the sub-resin component, a styrene-acrylic resin can be employed.

The third object of the present invention can be achieved by a printed matter produced by the above-mentioned image formation method.

BRIEF DESCRIPTION OF THE DRAWING

FIGURE is a schematic cross-sectional view of an image fixing unit for use in the present invention.

DESCRIPTION OF THE PREFERRED EMBODIMENTS

In the present invention, the glossiness of an image-fixed sample is measured by using a commercially available glossimeter (Trademark "VG-1D" made by Nippon Denshoku Kogyo Co., Ltd.), with a projecting light beam angle and a receiving light beam angle each being set at 60°, with a switch for selecting S or S/10 being set at S, making a zero adjustment and using a reference plate, by placing the image-fixed sample on a sample table after the standard setting has been made.

In the present invention, the term "maximum transferable amount" of each toner onto the image means the amount of the toner that can be transferred to the surface of an image receiving material when a solid image is formed thereon, using only one toner, by the image formation apparatus for use in the present invention.

In the case where the maximum transferable amount is more than $8\times10^{-3}$ kg/m$^2$, when full-color reproduction is performed, the amount of each toner transferred is so excessive that toner dust is apt to be formed, and non-uniform coloring is also apt to occur due to improper color mixing of the toners. Furthermore, due to the excess transfer of each toner, the transparency of the toner images formed on an OHP sheet becomes poor and the glossiness of the toner images is increased, so that proper images cannot be obtained.

On the other hand, when the maximum transferable amount is less than $4\times10^{-3}$ kg/m$^2$, the desired glossiness may be obtained, but the degree of pigmentation of each color is so low that light images with a low degree of pigmentation are obtained, which are of course improper images.

According to the present invention, there is set an upper limit with respect to the glossiness of each of (1) the black image and (2) the color images other than the black image formed in the multi-color image formation, and (3) the black image formed in the monochrome image formation, so that each glossiness can be prevented from becoming excessively high, and excessive coloring of the black toner can be suppressed by making the glossiness of the black color lower than the glossiness of the other colors in a multi-color image, whereby a steady, well-balanced and nice-looking multi-color image can be obtained.

Some glossiness is required for images produced, in particular, for a photographic image. Otherwise, the produced images will look poor.

Furthermore, in the multi-color image formation, when the image glossiness (GKC) obtained by the black toner in the maximum transferable amount thereof at the multi-color image printing, and the image glossiness (GCC) obtained by each of the color toners other than the black toner in the maximum transferable amount thereof at the multi-color image printing satisfy the relationship of $0.5 \leqq GKC/GCC \leqq 0.9$, a well-balanced color image can be obtained even in the case of a photographic image in which black portions and colored portions other than the black portions are mixed.

When the ratio of GKC/GCC is more than 0.9, the monochromic black portions have high glossiness and therefore become excessively conspicuous, while when the ratio is less than 0.5, the coloring of the black portions is reduced and the glossiness of the black portions is also more reduced in comparison with the colored portions other than the black-portions. The result is that the black portions becomes conspicuous in a full-color photographic image, and the produced multi-color image looks unbalanced as a whole.

It is preferable that the ratio be in a relationship of $0.6 \leqq GKC/GCC \leqq 0.85$.

In the multi-color image formation, it is required that the black portion have a certain glossiness for the reasons as mentioned above. In the monochrome image formation, however, it is desired that the black portion have less glossiness than in the case of the multi-color image formation. In order to satisfy the above requirements, in the present invention, the image glossiness (GKC) obtained by the black toner in the maximum transferable amount thereof at the multi-color image printing, the image glossiness (GCC) obtained by each of the color toners other than the black toner in the maximum transferable amount thereof at the multi-color image printing, and the image glossiness (GKM) obtained by the black toner in the maximum transferable amount thereof at the monochrome image printing satisfy the relationship of:

$$4 \leqq GKC \leqq 25(\%),$$

$$5 \leqq GCC \leqq 30(\%),$$

$$1 \leqq GKM \leqq 10(\%),$$

$$0.5 \leqq GKC/GCC \leqq 0.9,$$

$$0.1 \leqq GKM/GKC \leqq 0.7,$$

and $$GKM \leqq GKC \leqq GCC.$$

FIGURE shows an example of an image fixing unit for use in the present invention. An unfixed toner image 8 is fixed to an image transfer sheet 9 with the application of pressure to the toner image 8 by both an image fixing roller 1 and a pressure application roller 2. The image fixing roller 1 includes a heat-resistant releasing layer 3 made of, for example, silicone rubber, on the surface thereof. The pressure application roller 2 also includes a heat-resistant releasing layer 4 made of, for example, fluoroplastics on the surface thereof. Silicone oil 7 is applied to the surface of the image fixing roller 1 through an oil application felt 6, thereby preventing toner from adhering to the surface of the image fixing roller 1. The image transfer sheet 9 is peeled away from the surface of the image fixing roller 1 by a separator 11. The surface of each of the image fixing roller 1 and the heat application roller 2 is heated by a heater 5 and the surface temperatures thereof are appropriately controlled by a thermistor (not shown) for fixing the toners. A felt 10 for cleaning the surface of the image fixing roller 1 may be provided between the oil application felt 6 and the separator 11. The same felt as the felt 10 may also be provided on the surface of the pressure application roller 2.

In the present invention, it is preferable that the thermal energy for image fixing applied by the image fixing unit be changed in order to change the glossiness of the black toner image, depending upon the choice of the multi-color image formation or the monochrome image formation. Generally, the thermal energy for image fixing can be changed by changing, for example, image fixing temperature, nip width for image fixing, or fixing line speed. The method of changing the image fixing temperature is not preferable because it takes time to change the image fixing temperature. The method of changing the nip width is not preferable, either, because a device for controlling pressure to change the nip width is required. Thus, it is preferable to change image fixing line speed depending upon the choice of the multi-color image printing or the monochrome image printing. It is more preferable that the image fixing line speed be set under the conditions of:

$1.2 \leqq$(image fixing line speed at monochrome image printing/image fixing line speed at multi-color image printing)$\leqq 2.0$.

When the ratio of image fixing line speed at monochrome image printing/image fixing line speed at multi-color image printing is more than 2.0, the risks that the glossiness will become excessive at the multi-color image printing and hot offset will take place are increased. On the other hand, when the ratio is less than 1.2, is it difficult to form an appropriate difference in the glossiness between the black image formed at the monochrome printing and the black image formed at the multi-color printing, so that the desired images cannot be obtained.

In order to obtain further better images, it is preferable that the image fixing line speed be set under the conditions of:

1.3≦(image fixing line speed at monochrome image printing/image fixing line speed at multi-color image printing)≦1.9.

It is also important to optimize the amount of the oil applied for obtaining a stabilized glossiness. A lower limit of the oil applied can be determined depending upon the conditions under which the offset of toner images onto the image fixing roller does not take place. An upper limit of the oil applied can be determined depending upon the conditions under which the oil transferred to the image receiving sheet does not give any unpleasant feeling to the user. The unpleasant feeling specifically means such feeling that is caused by increased curling of a printed image receiving paper with high printing ratio or sliminess that is caused by the adhesion of excess oil to a printed surface of the image receiving sheet.

However, in order to determine the lower limit and the upper limit of the amount of the applied oil, it is necessary to take the glossiness taken into consideration. A satisfactory glossiness range generally exists in a range which is narrower than a range determined by a lower limit determined by offset and an upper limit determined by the unpleasant feeling. Therefore, in order to satisfy the above-mentioned glossiness, it is preferable to control the amount of the oil applied so as to be present in such a range that is as closer as possible to the lower limit. When the maximum transferable amount of each color toner on the image is in the range of $4\times10^{-3}$ Kg/m$^2$ to $8\times10^{-3}\times$Kg/m$^2$, the amount of the oil applied is 2.5 mg to 3.5 mg per A4-size sheet, namely $3\times10^{-5}$ Kg/m$^2$ to $8\times10^{-5}\times$Kg/m$^2$, preferably $4\times10^{-5}$ Kg/m$^2$ to $6\times10^{-5}\times$Kg/m$^2$, under the conditions that the nip width is 4.5±0.5 mm, the nip pressure is 15±3 kgf, and the image fixing temperature is 140±5° C.

As the binder resin for use in the toners in the present invention, conventional binder resins, specifically, binder resins used in conventional toners can be employed. Examples of such binder resins are polyol resin; homopolymers of styrene and substituted styrenes such as styrene-acrylic copolymer, polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylethyl eter copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer; poly (methyl methacrylate); poly(butyl methacrylate); poly(vinyl chloride); poly(vinyl acetate); polyethylene; polypropylene; polyester; polyvinyl butyl butyral; polyacrylic acid resin; rosin; modified rosin; terpene resin; phenolic resin; aliphatic hydrocarbon resin or alicyclic hydrocarbon resin; aromatic petroleum resin; chlorinated paraffin; and paraffin wax. These can be used alone or in combination.

It is preferable that a resin component for each of the plurality of the color toners other than the black toner have a weight-average molecular weight (Mw) of 10,000 to 25,000, and a number-average molecular weight (Mn) of 2,000 to 7,000, with the ratio of the weight-average molecular weight (Mw) to the number-average molecular weight (Mn), Mw/Mn, being 3 to 10.

When the weight-average molecular weight (Mw) of the resin component is more than 25,000, it is difficult to secure appropriate image fixing performance by changing thermal energy for image fixing, while when the weight-average molecular weight (Mw) of the resin component is less than 10,000, the glossiness becomes so excessive that such a resin component is not suitable for use in practice.

When the number-average molecular weight (Mn) of the resin component is less than 2,000, problems are caused with respect to the heat resistance and the preservability of the toner for an extended period of time, while when the number-average molecular weight (Mn) of the resin component is more than 7,000, the image fixing temperature has to be raised, which is not preferable when used in practice.

When the ratio of the weight-average molecular weight (Mw) to the number-average molecular weight (Mn), that is, Mw/Mn, is more than 10, a sufficient glossiness cannot be obtained when toner images are formed on a thick image transfer sheet or on an OHP sheet, while when the ratio, Mw/Mn, is less than 3, the risk of the occurrence of high temperature offset can be increased.

It is preferable that the resin component be polyester resin, since polyester resin has advantages in terms of the production of the toners and the preservability thereof over other resins.

In the black toner, there can be employed the same binder resins as mentioned above. In the same manner as in the case of the color toners other than the black toner, it is preferable to use for the black toner such a resin component that has a weight-average molecular weight (Mw) of 10,000 to 25,000, and a number-average molecular weight (Mn) of 2,000 to 7,000, with the ratio of the weight-average molecular weight (Mw) to the number-average molecular weight (Mn), Mw/Mn, being 3 to 10.

As to the glossiness of the black image produced by the black toner, it is necessary to make such an adjustment that the glossiness of the black image is made smaller than the glossiness of each of the color images produced by the plurality of color toners other than the black toner.

In order to make such an adjustment, it is preferable that a sub-resin component which is non-compatible with the above-mentioned resin component be added to the black toner in an amount of 1 to 10 parts by weight to 100 parts by weight of the resin component.

When the sub-resin component is added in an amount of 1 part by weight or more to 100 parts by weight of the resin component, the glossiness of the black image can be made smaller than the glossiness of each of the color images produced by the plurality of color toners other than the black toner. However, when the amount of the sub-resin components exceeds 10 parts by weight to 100 parts by weight of the resin component, the glossiness of the image produced by the black toner is excessively reduced, so that the desired glossiness cannot be obtained.

Furthermore, it is preferable that the sub-resin component have a melt index (MI) value of 1 to 30, since a polymer component having such an MI value has high non-compatibility and therefore the desired glossiness can be obtained.

It is furthermore preferable that the sub-resin component be a styrene-acrylic resin, which is capable of providing a well-balanced glossiness.

In the present invention, the molecular weight and the MI value of the toner or the resin are measured as follows:

Weight-average molecular weight: GPC (gas permeation chromatography) is used for the measurement of the weight-average molecular weight of a sample toner or resin. A column is stabilized in a heat chamber at 40° C. THF serving as a solvent is caused to flow through the column at a flow rate of 1 ml per minute. 50 to 200 $\mu$l of a THF sample solution of a toner or a resin with the concentration thereof adjusted to 0.05 to 0.6 wt. % is injected into the column for the measurement of the weight-average molecular weight thereof.

MI value: 5 g of a toner or resin sample is allowed to stand in FLOW RATE COUNTER TYPE-C-5059D made by Toyo Seiki Seisaku-Sho, Ltd. The MI value (10 min/g) of the sample is measured under the conditions that a plunger pressure is set at 2160 g, and an equilibrium temperature after heat elevation is set at 150° C.

As the coloring agent for use in the toner of the present invention, conventionally known dyes and pigments can be employed. Examples of the dyes and pigments are carbon black, nigrosine dyes, black iron oxide, Naphthol Yellow S, Hansa Yellow (10G, 5G, G), cadmium yellow, yellow iron oxide, yellow ochre, chrome yellow, Titan Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, iso-indolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chrome oxide, Persian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. It is preferable that the amount of the coloring agent be in the range of 0.1 to 50 parts by weight to 100 parts by weight of the binder resin.

The colors of the plurality of the color toners for use in the present invention may be any color, but it is preferable that they be such colors that can produce a full-color image.

It is also preferable that the colors of the plurality of the color toners other than the black toner be three colors, yellow, cyan, and magenta because the number of developments can be minimized, and colors with a relatively large color tone range can be covered by such color toners.

Each of the toners of the present invention may further comprise a charge controlling agent. Any conventional charge controlling agents can be used in the present invention. For instance, there can be employed a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus element, a phosphorus compound, tungsten element, a tungsten compound, a fluorine-containing active material, a metallic salt of salicylic acid, and a metallic salt of a salicylic acid derivative.

The amount of such a charge controlling agent used in each toner can be adjusted in accordance with the kind of binder resin employed in the toner and the use or non-use of an additive in the toner, and also in accordance with the method of producing the toner, including the dispersion method employed in producing the toner. Thus, the amount of the charge controlling agent used in the toner cannot be limited unconditionally. However, generally the amount of the charge controlling agent is 0.1 to 10 parts by weight to 100 parts by weight of the binder resin, preferably 2 to 5 parts by weight to 100 parts by weight of the binder resin.

When the amount of the charge controlling agent is less than 0.1 parts by weight, the negative charging of the toner is insufficient for use in practice, while when the amount of the charge controlling agent is more than 10 parts by weight, the chargeability of the toner is so excessive that the electrostatic attraction between carriers and a development sleeve is increased and the so-called spent phenomenon and the filming of the toners take place, whereby image density obtained is lowered. When necessary, a plurality of charge controlling agents can be used in combination.

In the present invention, development can be carried out by a one-component development method, using the toner of the present invention alone as a mono-component ideveloper for developing a latent electrostatic image to a toner image, or by a two-component development method, using the toner of the present invention in combination with a carrier as a two-component developer for developing a latent electrostatic image to a toner image.

As the carrier for use in the two-component development method, conventionally known materials such as iron powders, ferrite particles and glass beads can be employed. These carrier particles may be coated with a resin, such as polyfluorocarbon, polyvinyl chloride, polyvinylidene chloride, phenolic resin, polyvinyl acetal or silicone resin. In the two-component development method, it is appropriate that the amount of the toner is in the range of about 0.5 to 6.0 parts by weight to 100 parts by weight of the carrier.

The black toner and the plurality of the color toners other than the black toner may be mixed with an additive when necessary.

As an additive which is to be externally added, finely-divided inorganic particles are preferable for use in the present invention.

It is preferable that such finely-divided inorganic particles have a primary particle diameter of 5 nm to 2 $\mu$m, more preferably 5 nm to 500 nm. It is also preferable that the specific surface area of the finely-divided inorganic particles, measured by B.E.T. method, be in the range of 20 to 500 $m^2/g$. It is also preferable that the amount of the finely-divided inorganic particles be in the range of 0.01 to 5 parts by weight to 100 parts by weight of the toner, more preferably in the range of 0.01 to 2.0 parts by weight to 100 parts by weight of the toner.

Specific examples of such finely-divided inorganic particles are finely-divided particles of silica, alumina, titanium oxide, barium titanate, magnesium titanate, potassium titanate, strontium titanate, zinc oxide, tin oxide, quartz sand, clay, mica, wollastonite, diatomaceous earth, chrome oxide, cerium oxide, red oxide, antimony trioxide, magnesium oxide, zirconium oxide, barium sulfate, barium carbonate, potassium carbonate, silicon carbide, and silicon nitride. In addition, there can be employed finely-divided particles of polymers obtained by soap-free emulsion polymerization, suspension polymerization, dispersion polymerization, poly-condensation, such as polystyrene, methacrylic acid ester, acrylic acid ester copolymer, silicone, polymers made from benzoguanamine, nylon, and thermosetting resin.

It is preferable that the black toner and the plurality of color toners other than the black toner of the present invention be produced by mixing the above-mentioned components in a mixer such as a Henschel mixer, kneading the mixture in a continuous kneader or a roll kneader with the application of heat thereto, cooling and solidifying the kneaded mixture, pulverizing the solidified mixture, and classifying the pulverized mixture to obtain toner particles with a desired average particle diameter, whereby the desired toner is obtained.

In addition, the toners of the present invention can be produced by a spray drying method, a polymerization method, or a micro-capsule method. When necessary, the thus obtained toners may be sufficiently mixed with an additive in a mixer such as a Henschel mixer.

Other features of this invention will become apparent in the course of the following description of exemplary embodiments, which are given for illustration of the invention and are not intended to be limiting thereof.

SYNTHESIS EXAMPLE 1

Synthesis of Polyester Resin A1

In a four-necked separable flask equipped with a stirrer, a thermometer, a nitrogen gas introduction inlet, a reflux condenser, and a cooling pipe, there was placed a reaction mixture with the following formulation, together with an esterification catalyst:

Formulation of Reaction Mixture

| | |
|---|---|
| polyoxypropylene(2,2)-2,2-bis-(4-hydroxyphenyl)propane | 740 g |
| polyoxyethylene(2,2)-2,2-bis-(4-hydroxyphenyl)propane | 300 g |
| dimethyl terephthalate | 466 g |
| isododecenyl succinic anhydride | 80 g |
| tri-n-butyl 1,2,4-benzenetricarbonate | 114 g |

The temperature of the above reaction mixture was raised to 210° C. at normal pressure in an atmosphere of nitrogen, and the reaction mixture was then allowed to react, with stirring, in the atmosphere of nitrogen at 210° C. under reduced pressure, whereby a polyester resin was obtained, which polyester resin is hereinafter referred to as polyester resin A1.

The thus obtained polyester resin A1 had the following properties:

Acid value: 2.3 KOHmg/g,

Hydroxyl value: 28.0 KOHmg/g,

Softening point: 106° C.,

Tg: 62° C.,

Mn=2,900,

Mw=15,000,

Mw/Mn=5.2

SYNTHESIS EXAMPLE 2

Synthesis of Polyester Resin A2

In the same four-necked separable flask as employed in Synthesis Example 1, there was placed a reaction mixture with the following formulation, together with an esterification catalyst, and the reaction was conducted in the same manner as in Synthesis Example 1:

Formulation of Reaction Mixture

| | |
|---|---|
| polyoxypropylene(2,2)-2,2-bis-(4-hydroxyphenyl)propane | 650 g |
| polyoxyethylene(2,2)-2,2-bis-(4-hydroxyphenyl)propane | 650 g |
| isophthalic acid | 515 g |
| isooctenyl succinic acid | 70 g |
| 1,2,4-benzenetricarbonic acid | 80 g |

Thus, a polyester resin was obtained, which polyester resin is hereinafter referred to as polyester resin A2.

The thus obtained polyester resin A2 had the following properties:

Acid value: 19.5 KOHmg/g,

Hydroxyl value: 35.0 KOHmg/g,

Softening point: 110° C.,

Tg: 60° C.,

Mn=6,800,

Mw=24,500,

Mw/Mn=3.6

SYNTHESIS EXAMPLE 3

Synthesis of Polyester Resin A3

In the same four-necked separable flask as employed in Synthesis Example 1, there was placed a reaction mixture with the following formulation, together with an esterification catalyst, and the reaction was conducted in the same manner as in Synthesis Example 1:

Formulation of Reaction Mixture

| | |
|---|---|
| polyoxypropylene(2,2)-2,2-bis-(4-hydroxyphenyl)propane | 314 g |
| polyoxyethylene(2,2)-2,2-bis-(4-hydroxyphenyl)propane | 863 g |
| isophthalic acid | 648 g |
| isooctenyl succinic acid | 150 g |
| 1,2,4-benzenetricarbonic acid | 100 g |

Thus, a polyester resin was obtained, which polyester resin is hereinafter referred to as polyester resin A3.

The thus obtained polyester resin A3 had the following properties:

Acid value: 21.0 KOHmg/g,

Hydroxyl value: 24.0 KOHpng/g,

Softening point: 128° C.,

Tg: 65° C.,

Mn=5,800,

Mw=55,500,

Mw/Mn=9.5

SYNTHESIS EXAMPLE 4

Synthesis of Polyester Resin A4

In the same four-necked separable flask as employed in Synthesis Example 1, there was placed a reaction mixture with the following formulation, together with an esterification catalyst, and the reaction was conducted in the same manner as in Synthesis Example 1.

Formulation of Reaction Mixture

| | |
|---|---|
| polyoxypropylene(2,2)-2,2-bis-(4-hydroxyphenyl)propane | 1225 g |
| polyoxyethylene(2,2)-2,2-bis-(4-hydroxyphenyl)propane | 165 g |
| terephthalic acid | 500 g |
| isododecenyl succinic anhydride | 130 g |
| tri-isopropyl 1,2,4-benzene-tricarbonate | 170 g |

Thus, a polyester resin was obtained, which polyester resin is hereinafter referred to as polyester resin A4.

The thus obtained polyester resin A4 had the following properties:

Acid value: 0.5 KOHmg/g,

Hydroxyl value: 25.0 KOHmg/g,

Softening point: 109° C.,

Tg: 63° C.,

Mn=5,800,

Mw=15,000,

Mw/Mn=2.6

SYNTHESIS EXAMPLE 5

Synthesis of Polyester Resin A5

The procedure of synthesizing polyester resin A4 in Synthesis Example 4 was repeated except that the reaction time was shortened in comparison with the reaction time in Synthesis Example 4, whereby a polyester resin having the following properties was synthesized, which polyester resin is hereinafter referred to as polyester resin A5:

Acid value: 0.5 KOHmg/g,

Hydroxyl value: 25.0 KOHmg/g,

Softening point: 109° C.,

Tg: 63° C.,

Mn=2,900,

Mw=5,800,

Mw/Mn=2.0

SYNTHESIS EXAMPLE 6

Synthesis of Polyol Resin A6

In the same four-necked separable flask as employed in Synthesis Example 1, there was placed a reaction mixture with the following formulation:

| | |
|---|---|
| low-molecular weight bisphenol A type epoxy resin (number-average molecular weight: about 360) | 205.3 g |
| polymeric bisphenol A type epoxy resin (number-average molecular weight: about 3000) | 54.0 g |
| glycidyl bisphenol A type propylene oxide adduct | 432.0 g |
| bisphenol F | 282.7 g |
| p-cumenylphenol | 26.0 g |
| xylene | 200 g |

The temperature of the above reaction mixture was raised to 70° C. to 100° C. in an atmosphere of nitrogen. To this reaction mixture, 0.183 g of lithium chloride was added.

The temperature of the reaction mixture was further raised to 160° C. and xylene was distilled out under reduced pressure. The reaction mixture was then allowed to react at 180° C. for 6 to 9 hours to carry out polymerization, whereby a polyol resin having the following properties, which is hereinafter referred to as polyol resin A6, was obtained:

Acid value: 0.0 KOHmg/g,

Hydroxyl value: 58.0, KOHmg/g,

Softening point: 109° C.,

Tg: 62° C.,

Mn=3,200,

Mw=13,000,

Mw/Mn=4.1

EXAMPLE 1

Preparation of Black Toner No. 1

| | Parts by Weight |
|---|---|
| Resin component: polyester resin A1 (synthesized in Synthesis Example 1) | 100 |
| Charge controlling agent: zinc salicylate derivative | 4 |
| Sub-resin component: Styrene-acrylic resin B1 (styrene/n-butyl acrylate/2-ethylhexyl acrylate copolymer) (MI value: 5, Tg: 65° C.) | 5 |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, and pulverized in a jet mill, whereby finely-divided particles were obtained. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 1 for use in the present invention was prepared.

Preparation of Yellow Toner No. 1

The same procedure for preparing the black toner as in the above was repeated except that styrene-acrylic resin B1 serving as sub-resin component was eliminated from the formulation, and 5 parts by weight of the coloring agent for the black toner were replaced by 5 parts by weight of a disazo yellow pigment (C.I. Pigment Yellow 17), whereby a yellow toner No. 1 for use in the present invention was prepared.

Preparation of Cyan Toner No. 1

The same procedure for preparing the black toner as in the above was repeated except that styrene-acrylic resin B1 serving as sub-resin component was eliminated from the formulation, and 5 parts by weight of the coloring agent for the black toner were replaced by 4 parts by weight of a copper phthalocyanine blue pigment (C.I. Pigment Blue 15), whereby a cyan toner No. 1 for use in the present invention was prepared.

Preparation of Magenta Toner No. 1

The same procedure for preparing the black toner as in the above was repeated except that styrene-acrylic resin B1 serving as sub-resin component was eliminated from the formulation, and 5 parts by weight of the coloring agent for the black toner were replaced by 4 parts by weight of C.I. Pigment Red 184, whereby a magenta toner No. 1 for use in the present invention was prepared.

The above prepared toners were set in a test printer which was made by modifying a commercially available printer (Trademark "GL-8300" made by Fujitsu Limited), and toner images were made and fixed with the maximum transferable amount of each toner under the conditions that the image fixing temperature was set at 140° C., the line speed of image fixing at multi-color printing was 57 mm/s, the line speed of image fixing at monochrome printing was 91 mm/s, with the ratio of the image fixing line speed at monochrome printing to the image fixing line speed at multi-color printing being 1.6, the image fixing nip pressure was 15 kgf, and the nip width was set at 4 to 4.5 mm.

As the image transfer sheet for the above-mentioned multi-color printing and monochrome printing, a commercially available image transfer sheet (Trademark "TYPE 6000 (70W)" made by Ricoh Company, Ltd.) was employed, so that the glossiness of an image made by the multi-color printing and the glossiness of an image made by the monochrome printing were measured.

Furthermore, by use of 1000 sheets of NBS copying paper 135k made by Ricoh Company, Ltd., multi-color printing was conducted to assess the image fixing performance.

At the image fixing, the amount of silicone oil applied was set at $5\times10^{-5}$ kg/m$^2$.

The result was that well-balanced images were obtained, with excellent image fixing performance. TABLE 1 shows the results of the evaluation of the toners, including the evaluation conditions and GCC, GKC, GKM, GKC/GCC, and GKM/GKC.

EXAMPLE 2

The same evaluation test procedure for the same toners as in Example 1 was repeated except that the line speed of image fixing at monochrome printing was changed from 91 mm/s to 125 mm/s, with the ratio of the image fixing line speed at monochrome printing to the image fixing line speed at multi-color printing being 2.2, and that the amount of silicone oil applied at the image fixing was changed from $5\times10^{-5}$ kg/m$^2$ to $10\times10^{-5}$ kg/m$^2$.

The result was that images obtained had no problems, but when a thick image transfer sheet was used, image fixing performance was partly not good. When a sheet of plain paper was used as the image transfer sheet, curling thereof was observed relatively conspicuously.

EXAMPLE 3

Preparation of Black Toner No. 2

The procedure for preparing Black Toner No. 1 in Example 1 was repeated except that the amount of styrene-acrylic resin Bi serving as sub-resin component was increased from 5 parts by weight to 10 parts by weight, whereby a black toner No. 2 for use in the present invention was prepared.

The same color toners, yellow toner No. 1, cyan toner No. 1 and magenta toner No. 1 as prepared in Example 1 were prepared.

The same evaluation test procedure as in Example 1 was repeated except that the black toner No. 1 employed in Example 1 was replaced by the above prepared black toner No. 2, and that the line speed of image fixing at monochrome printing was changed from 91 mm/s to 108 mm/s, with the ratio of the image fixing line speed at monochrome printing to the image fixing line speed at multi-color printing being 1.9. The amount of silicone oil applied at the image fixing was maintained at $5\times10^{-5}$ kg/m$^2$, which was the same as in Example 1.

The result was that images obtained had no substantial problems, although the glossiness of the monochrome image was relatively low at the multi-color printing. The image fixing performance was good. The evaluation results are shown in TABLE 1.

EXAMPLE 4

Preparation of Black Toner No. 3

| | Parts by Weight |
|---|---|
| Resin component: polyol resin A6 (synthesized in Synthesis Example 6, Mn = 3,200, Mw = 13,000, and Mw/Mn = 4.1) | 100 |
| Charge controlling agent: zinc salicylate derivative | 4 |
| Sub-resin component: Styrene-acrylic resin B1 (styrene/n-butyl acrylate/ 2-ethylhexylacrylate copolymer) (MI value: 5, Tg: 65° C.) | 5 |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, and pulverized in a jet mill, whereby finely-divided particles were obtained. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 3 for use in the present invention was prepared.

Preparation of Yellow Toner No. 2

The same procedure for preparing the black toner as in the above was repeated except that styrene-acrylic resin B1 serving as sub-resin component was eliminated from the formulation and 5 parts by weight of the coloring agent for the black toner were replaced by 5 parts by weight of a disazo yellow pigment (C.I. Pigment Yellow 17), whereby a yellow toner No. 2 for use in the present invention was prepared.

Preparation of Cyan Toner No. 2

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of a copper phthalocyanine blue pigment (C.I. Pigment Blue 15), whereby a cyan toner No. 2 for use in the present invention was prepared.

Preparation of Magenta Toner No. 2

The same procedure for preparing the black toner as in the above was repeated except that styrene-acrylic resin B1 serving as sub-resin component was eliminated from the formulation, and 5 parts by weight of the coloring agent for the black toner were replaced by 4 parts by weight of C.I. Pigment Red 184, whereby a magenta toner No. 2 for use in the present invention was prepared.

The same evaluation test procedure as in Example 1 was repeated except that the black toner No. 1 was replaced by the above prepared black toner No. 3, and the yellow toner No. 1, the cyan toner No. 1 and the magenta toner No. 1 employed in Example 1 were respectively replaced by the above prepared yellow toner No. 2, cyan toner No. 2 and magenta toner No. 2, that the line speed of image fixing at monochrome printing was changed from 91 mm/s to 68 mm/s, with the ratio of the image fixing line speed at monochrome printing to the image fixing line speed at multi-color printing being 1.2, and that the amount of silicone oil applied at the image fixing was changed from $5\times10^{-5}$ kg/m$^2$ to $10\times10^{-5}$ kg/m$^2$.

The result was that images obtained had no substantial problems, although the glossiness was relatively high. The image fixing performance was good. When a sheet of plain paper was used as the image transfer sheet, curling thereof was observed relatively conspicuously. The evaluation results are shown in TABLE

EXAMPLE 5

Preparation of Black Toner No. 4

| | Parts by Weight |
|---|---|
| Resin component: polyester resin A2 (synthesized in Synthesis Example 2, Mn = 6,800, Mw = 24,500, and Mw/Mn = 3.6) | 100 |
| Charge controlling agent: zinc salicylate derivative | 4 |
| Sub-resin component: Styrene-acrylic resin B1 (styrene/n-butyl acrylate/ 2-ethylhexyl acrylate copolymer) (MI value: 5, Tg: 65° C.) | 5 |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, pulverized in a jet mill to obtain finely-divided particles. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 4 for use in the present invention was prepared.

Preparation of Yellow Toner No. 3

The same procedure for preparing the black toner as in the above was repeated except that styrene-acrylic resin B1 serving as sub-resin component was eliminated from the formulation and 5 parts by weight of the coloring agent for the black toner were replaced by 5 parts by weight of a disazo yellow pigment (C.I. Pigment Yellow 17), whereby a yellow toner No. 3 for use in the present invention was prepared.

Preparation of Cyan Toner No. 3

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of a copper phthalocyanine blue pigment (C.I. Pigment Blue 15), whereby a cyan toner No. 3 for use in the present invention was prepared.

Preparation of Magenta Toner No. 3

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of C.I. Pigment Red 184, whereby a magenta toner No. 3 for use in the present invention was prepared.

The same evaluation test procedure as in Example 1 was repeated except that the black toner No. 1 was replaced by the above prepared black toner No. 4, and the yellow toner No. 1, the cyan toner No. 1 and the magenta toner No. 1 employed in Example 1 were respectively replaced by the above prepared yellow toner No. 3, cyan toner No. 3 and magenta toner No. 3, and that the amount of silicone oil applied at the image fixing was changed from $5\times10^{-5}$ kg/m$^2$ to $15\times10^{-5}$ kg/m$^2$.

The result was that images obtained had no substantial problems, although the glossiness of the images was relatively low as a whole. The image fixing performance was good. When a sheet of plain paper was used as the image transfer sheet, curling thereof was observed relatively conspicuously. The evaluation results are shown in TABLE 1.

EXAMPLE 6

Preparation of Black Toner No. 5

The procedure for preparing Black Toner No. 1 in Example 1 was repeated except that the styrene-acrylic resin B1 serving as sub-resin component employed in Example 1 was replaced by 5 parts by weight of styrene-acrylic resin B2, which was a styrene/n-butyl acrylate copolymer (MI value: 5, Tg: 65° C.), whereby a black toner No. 5 for use in the present invention was prepared.

The same color toners, yellow toner No. 1, cyan toner No. 1 and magenta toner No. 1 as prepared in Example 1 were prepared.

The same evaluation test procedure as in Example 1 was repeated except that the black toner No. 1 was replaced by the above prepared black toner No. 5.

The result was that images obtained had no substantial problems, although the glossiness of the monochrome image was relatively high. There was no problem with the image fixing performance. The evaluation results are shown in TABLE 1.

EXAMPLE 7

Preparation of Black Toner No. 6

| | Parts by Weight |
|---|---|
| Resin component: polyester resin A3 (synthesized in Synthesis Example 3, Mn = 5,800, Mw = 55,500, and Mw/Mn = 9.5) | 100 |
| Charge controlling agent: zinc salicylate derivative | 4 |
| Sub-resin component: Styrene-acrylic resin B1 (styrene/n-butyl acrylate/2-ethylhexyl acrylate copolymer) (MI value: 5, Tg: 65° C.) | 5 |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, pulverized in a jet mill, whereby finely-divided particles were obtained. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 6 for use in the present invention was prepared.

Preparation of Yellow Toner No. 4

The same procedure for preparing the black toner as in the above was repeated except that styrene-acrylic resin B1 serving as sub-resin component was eliminated from the formulation and 5 parts by weight of the coloring agent for the black toner were replaced by 5 parts by weight of a disazo yellow pigment (C.I. Pigment Yellow 17), whereby a yellow toner No. 4 for use in the present invention was prepared.

Preparation of Cyan Toner No. 4

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of a copper phthalocyanine blue pigment (C.I. Pigment Blue 15), whereby a cyan toner No. 4 for use in the present invention was prepared.

Preparation of Magenta Toner No. 4

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of C.I. Pigment Red 184, whereby a magenta toner No. 4 for use in the present invention was prepared.

The same evaluation test procedure as in Example 1 was repeated-except that the black toner No. 1 was replaced by the above prepared black toner No. 6, and the yellow toner No. 1, the cyan toner No. 1 and the magenta toner No. 1 employed in Example 1 were respectively replaced by the above prepared yellow toner No. 4, cyan toner No. 4 and magenta toner No. 4, and that the amount of silicone oil applied at the image fixing was changed from $5\times10^{-5}$ kg/m$^2$ to $15\times10^{-5}$ kg/m$^2$.

The result was that the glossiness of images obtained was good. When a thick image transfer sheet was used, a so-called cold offset took place, with poor image fixing performance. The evaluation results are shown in TABLE 1.

EXAMPLE 8

Preparation of Black Toner No. 7

| | Parts by Weight |
|---|---|
| Resin component: polyester resin A4 (synthesized in Synthesis Example 4, Mn = 5,800, Mw = 15,000, and Mw/Mn = 2.6) | 100 |
| Charge controlling agent: zinc salicylate derivative | 4 |
| Sub-resin component: Styrene-acrylic resin B1 (styrene/n-butyl acrylate/2-ethylhexyl acrylate copolymer) (MI value: 5, Tg: 65° C.) | 5 |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, pulverized in a jet mil, whereby finely-divided particles were obtained. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 7 for use in the present invention was prepared.

Preparation of Yellow Toner No. 5

The same procedure for preparing the black toner as in the above was repeated except that styrene-acrylic resin B1 serving as sub-resin component was eliminated from the formulation and 5 parts by weight of the coloring agent for the black toner were replaced by 5 parts by weight of a disazo yellow pigment (C.I. Pigment Yellow 17), whereby a yellow toner No. 5 for use in the present invention was prepared.

Preparation of Cyan Toner No. 5

The same procedure for preparing the black toner as in the above was repeated except that styrene-acrylic resin Bi serving as sub-resin component was eliminated from the formulation and 5 parts by weight of the coloring agent for the black toner were replaced by 4 parts by weight of a copper phthalocyanine blue pigment (C.I. Pigment Blue 15), whereby a cyan toner No. 5 for use in the present invention was prepared.

Preparation of Magenta Toner No. 5

The same procedure for preparing the black toner as in the above was repeated except that styrene-acrylic resin Bi serving as sub-resin component was eliminated from the formulation and 5 parts by weight of the coloring agent for the black toner were replaced by 4 parts by weight of C.I. Pigment Red 184, whereby a magenta toner No. 5 for use in the present invention was prepared.

The same evaluation test procedure as in Example 1 was repeated except that the black toner No. 1 was replaced by the above prepared black toner No. 7, and the yellow toner No. 1, the cyan toner No. 1 and the magenta toner No. 1 employed in Example 1 were respectively replaced by the above prepared yellow toner No. 5, cyan toner No. 5 and magenta toner No. 5.

The result was that the glossiness of images obtained was good. However, when image formation was conducted, using 1000 image transfer sheets, improper image fixing took place with a cleaning portion being considerably smeared with the toners, and a so-called hot offset took place. The evaluation results are shown in TABLE 1.

Comparative Example 1

Using the same toners as used in Example 1, the same evaluation test procedure as in Example 1 was repeated except that the line speed of image fixing at monochrome printing was changed from 91 mm/s to 63 mm/s, with the ratio of the image fixing line speed at monochrome printing to the image fixing line speed at multi-color printing being 1.1.

The result was that there was not much difference in glossiness between a black image formed by multi-color printing and a black image formed by monochrome printing, so that the glossiness of the black images was excessively high. The evaluation results are shown in TABLE 1.

Comparative Example 2

Preparation of Black Toner No. 8

| | Parts by Weight |
|---|---|
| Resin component: polyester resin A5 (synthesized in Synthesis Example 5, Mn = 2,900, Mw = 5,800, and Mw/Mn = 2.0) | 100 |
| Charge controlling agent: zinc salicylate derivative | 4 |
| Sub-resin component: Styrene-acrylic resin B1 (styrene/n-butyl acrylate/2-ethylhexyl acrylate copolymer) (MI value: 5, Tg: 65° C.) | 5 |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, pulverized in a jet mill, whereby finely-divided particles were obtained. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 8 was prepared.

Preparation of Yellow Toner No. 6

The same procedure for preparing the black toner as in the above was repeated except that styrene-acrylic resin B1 serving as sub-resin component was eliminated from the formulation and 5 parts by weight of the coloring agent for the black toner were replaced by 5 parts by weight of a disazo yellow pigment (C.I. Pigment Yellow 17), whereby a yellow toner No. 6 was prepared.

Preparation of Cyan Toner No. 6

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of a copper phthalocyanine blue pigment (C.I. Pigment Blue 15), whereby a cyan toner No. 6 was prepared.

Preparation of Magenta Toner No. 6

The same procedure for preparing the black toner as in the above was repeated except that styrene-acrylic resin B1 serving as sub-resin component was eliminated from the formulation and 5 parts by weight of the coloring agent for the black toner were replaced by 4 parts by weight of C.I. Pigment Red 184, whereby a magenta toner No. 6 was prepared.

The same evaluation test procedure as in Example 1 was repeated except that the black toner No. 1 was replaced by the above prepared black toner No. 8, and the yellow toner No. 1, the cyan toner No. 1 and the magenta toner No. 1 employed in Example 1 were respectively replaced by the above prepared yellow toner No. 6, cyan toner No. 6 and magenta toner No. 6, and that the amount of silicone oil applied at the image fixing was changed from $5\times10^{-5}$ kg/m$^2$ to $10\times10^{-5}$ kg/m$^2$.

The result was that the glossiness of images obtained was excessively high in both black image and colored images other than the black image. Furthermore, when image formation was conducted, using 1000 image transfer sheets, improper image fixing took place with a cleaning portion being considerably smeared with the toners, and a so-called hot offset took place. The evaluation results are shown in TABLE 1.

Comparative Example 3

Preparation of Black Toner No. 9

| | Parts by Weight |
|---|---|
| Resin component: polyol resin A6 (synthesized in Synthesis Example 6, MN = 3,200, Mw = 13,000, and Mw/Mn = 4.1) | 100 |
| Charge controlling agent: | 4 |

-continued

| | Parts by Weight |
|---|---|
| zinc salicylate derivative | |
| Coloring agent: carbon black | 5 |

A mixture of the above components with the above formulation were fused and kneaded in a roll mill and was then cooled to obtain a solid mixture. The thus obtained solid mixture was then roughly crushed in a hammer mill, pulverized in a jet mill, whereby finely-divided particles were obtained. The thus obtained finely-divided particles were classified to obtain finely-divided particles with a particle diameter of about 9 $\mu$m.

The thus obtained finely-divided particles were mixed with hydrophobic silica (Trademark "R972" made by Nippon Aerosil Co., Ltd.) in a high-speed rotary mixer, whereby a black toner No. 9 was prepared.

Preparation of Yellow Toner No. 7

The same procedure for preparing the black toner as in the above was repeated except that 5 parts by weight of the coloring agent for the black toner were replaced by 5 parts by weight of a disazo yellow pigment (C.I. Pigment Yellow 17), whereby a yellow toner No. 7 was prepared.

Preparation of Cyan Toner No. 7

The same procedure for preparing the black toner as in the above was repeated except that 5 parts by weight of the coloring agent for the black toner were replaced by 4 parts by weight of a copper phthalocyanine blue pigment (C.I. Pigment Blue 15), whereby a cyan toner No. 7 was prepared.

Preparation of Magenta Toner No. 7

The same procedure for preparing the black toner as in the above was repeated except that 5 parts by weight of the coloring agent for the black toner were replaced by 4 parts by weight of C.I. Pigment Red 184, whereby a magenta toner No. 7 was prepared.

The same evaluation test procedure as in Example 1 was repeated except that the black toner No. 1 was replaced by the above prepared black toner No. 9, and the yellow toner No. 1, the cyan toner No. 1 and the magenta toner No. 1 employed in Example 1 were respectively replaced by the above prepared yellow toner No. 7, cyan toner No. 7 and magenta toner No. 7.

The result was that the glossiness of black images was higher than the glossiness of colored images. The evaluation results are shown in TABLE 1.

TABLE 1

| | Resin Component | | | | Sub-resin component (for black color toner) | | | | | | | | |
|---|---|---|---|---|---|---|---|---|---|---|---|---|---|
| | Resins | Mn 2–7 ×1000 | Mw 10–25 ×1000 | Mw/Mn 3–10 | Ml 1–30 | Contents 1–10 wt. % | Line speed of image fixing 1.2–2.00 | Oil applied kg/m$^2$ | GCC 5–30 | GKC 4–25 | GKM 0–10 | CKC/GCC 0.5–0.9 | GKM/GKC 0.1–0 |
| Ex. 1 | Polyester | 2900 | 15000 | 5.2 | 5 | 5 | 1.6 | $5 \times 10^{-5}$ | 20 | 15 | 3 | 0.75 | 0.20 |
| Ex. 2 | Polyester | 2900 | 15000 | 5.2 | 5 | 5 | 2.2 | $10 \times 10^{-5}$ | 20 | 15 | 2 | 0.75 | 0.13 |
| Ex. 3 | Polyester | 2900 | 15000 | 5.2 | 5 | 10 | 1.9 | $5 \times 10^{-5}$ | 20 | 10 | 2 | 0.50 | 0.20 |
| Ex. 4 | Polyol | 3200 | 13000 | 4.1 | 5 | 5 | 1.2 | $10 \times 10^{-5}$ | 22 | 19 | 10 | 0.86 | 0.53 |
| Ex. 5 | Polyester | 6800 | 24500 | 3.6 | 5 | 5 | 1.6 | $15 \times 10^{-5}$ | 13 | 9 | 4 | 0.69 | 0.44 |
| Ex. 6 | Polyester | 2900 | 15000 | 5.2 | 50 | 5 | 1.6 | $5 \times 10^{-5}$ | 20 | 18 | 7 | 0.90 | 0.39 |
| Ex. 7 | Polyester | 5800 | 55000 | 9.5 | 5 | 5 | 1.6 | $15 \times 10^{-5}$ | 15 | 11 | 2 | 0.73 | 0.18 |
| Ex. 8 | Polyester | 5800 | 15000 | 2.6 | 5 | 5 | 1.6 | $5 \times 10^{-5}$ | 23 | 17 | 5 | 0.74 | 0.29 |
| Comp. Ex. 1 | Polyester | 2900 | 15000 | 5.2 | 5 | 5 | 1.1 | $5 \times 10^{-5}$ | 23 | 21 | 19 | 0.91 | 0.90 |
| Comp. Ex. 2 | Polyester | 2900 | 5800 | 2.0 | 5 | 5 | 1.6 | $10 \times 10^{-5}$ | 33 | 28 | 12 | 0.85 | 0.40 |
| Comp. Ex. 3 | Polyol | 3200 | 13000 | 4.1 | — | 0 | 1.6 | $5 \times 10^{-5}$ | 22 | 25 | 5 | 1.14 | 0.20 |

Japanese Patent Application No. 11-226323 filed Aug. 10, 1999 is hereby incorporated by reference.

What is claimed is:

1. An image formation method for forming an image, using an image formation apparatus capable of performing (1) multi-color image formation and printing by superimposing toner images with different colors by use of a plurality of color toners with different colors, including at least a black toner, and (2) monochrome image formation and printing, using only a black toner, with a maximum transferable amount of each color toner onto said image being in a range of $4\times10^{-3}$ kg/m$^2$ to $8\times10^{-3}$ kg/m$^2$, wherein an image glossiness (GKC) obtained by said black toner in said maximum transferable amount thereof at said multi-color image printing, an image glossiness (GCC) obtained by each of said color toners other than said black toner in said maximum transferable amount thereof at said multi-color image printing, and an image glossiness (GKM) obtained by said black toner in said maximum transferable amount thereof at said monochrome image printing satisfy the relationship of:

$$4 \leqq GKC \leqq 25(\%),$$

$$5 \leqq GCC \leqq 30(\%),$$

$$0.1 \leqq GKM \leqq 10(\%),$$

$$0.5 \leqq GKC/GCC \leqq 0.9,$$

$$0.1 \leqq GKM/GKC \leqq 0.7,$$

and $$GKM \leqq GKC \leqq GCC.$$

2. The image formation method as claimed in claim 1, wherein said multi-color image printing and said monochrome image printing respectively comprise multi-color image fixing and monochrome image fixing which are conducted at an identical image fixing temperature and at an identical nip pressure, with the respective image fixing line speeds thereof satisfying the conditions of:

1.2≦(image fixing line speed at monochrome image printing/image fixing line speed at multi-color image printing)≦2.0.

3. The image formation method as claimed in claim 2, wherein said multi-color image fixing and said monochrome image fixing are conducted, using an image fixing roller which is coated with a silicone oil component with a viscosity of 1 to 1000 stokes in an amount of $3\times10^{-5}$ kg/m$^2$ to $8\times10^{-5}$ kg/m$^2$.

4. The image formation method as claimed in claim 1, wherein each of the plurality of said color toners other than said black toner is an electrophotographic toner comprising a coloring agent, and a resin component with a weight-average molecular weight (Mw) of 10,000 to 25,000, and a number-average molecular weight (Mn) of 2,000 to 7,000, with the ratio of said weight-average molecular weight (Mw) to said number-average molecular weight (Mn), Mw/Mn, being 3 to 10, and said black toner is an electrophotographic toner comprising a coloring agent, said resin component, and at least one sub-resin component which is non-compatible with said resin component in an amount of 1 to 10 parts by weight to 100 parts by weight of said resin component.

5. The image formation method as claimed in claim 4, wherein said resin component is polyester resin.

6. The image formation method as claimed in claim 4, wherein said sub-resin component has an MI value of 1 to 30.

7. The image formation method as claimed in claim 6, wherein said sub-resin component is a styrene-acrylic resin.

8. The image formation method as claimed in claim 4, wherein said sub-resin component is a styrene-acrylic resin.

9. The image formation method as claimed in claim 1, wherein the plurality of said color toners other than said black toner comprises a yellow color toner, a magenta color toner, and a cyan color toner.

10. A printed matter printed by an image formation method for forming an image, using an image formation apparatus capable of performing (1) multi-color image formation and printing by superimposing toner images with different colors by use of a plurality of color toners with different colors, including at least a black toner, and (2) monochrome image formation and printing, using only a black toner, with a maximum transferable amount of each color toner onto said image being in a range of $4\times10^{-3}$ kg/m$^2$ to $8\times10^{-3}$ kg/m$^2$, wherein an image glossiness (GKC) obtained by said black toner in said maximum transferable amount thereof at said multi-color image print, an image glossiness (GCC) obtained by each of said color toners other than said black toner in said maximum transferable amount thereof at said multi-color image printing, and an image glossiness (GKM) obtained by said black toner in said maximum transferable amount thereof at said monochrome image printing satisfy the relationship of:

$$4 \leqq GKC \leqq 25(\%),$$

$$5 \leqq GCC \leqq 30(\%),$$

$$1 \leqq GKM \leqq 10(\%),$$

$$0.5 \leqq GKC/GCC \leqq 0.9,$$

$$0.1 \leqq GKM/GKC \leqq 0.7,$$

and $$GKM \leqq GKC \leqq GCC.$$

* * * * *

UNITED STATES PATENT AND TRADEMARK OFFICE

CERTIFICATE OF CORRECTION

PATENT NO. : 6,432,589 B1 
DATED : August 13, 2002
INVENTOR(S) : Uchinokura et al.

It is certified that error appears in the above-identified patent and that said Letters Patent is hereby corrected as shown below:

Column 10,
Line 32, “ideveloper” should read -- developer --.

Column 16,
Line 9, “Bi” should read -- B1 --.

Column 17,
Line 45, “TABLE” should read -- TABLE 1 --.

Column 20,
Line 66, “Bi” should read -- B1 --.

Column 21,
Line 9, “Bi” should read -- B1 --.

Columns 23 & 24,
Table 1, last column, header “GKM/GKC” should read -- GKM/GKC --; and
0.1-0 0.1-0.7
Comparative Ex. 2, “0.40” should read -- 0.43 --.

Signed and Sealed this

Sixth Day of May, 2003

JAMES E. ROGAN
*Director of the United States Patent and Trademark Office*